US008664158B2

(12) United States Patent
Vavassori Bisutti

(10) Patent No.: US 8,664,158 B2
(45) Date of Patent: Mar. 4, 2014

(54) MEDIA USED FOR TRANSFERRING AN IMAGE ON A BI-DIMENSIONAL OR TRI-DIMENSIONAL ARTICLE BY A THERMAL TRANSFER PRINTING PROCESS AND PROCESS FOR MAKING SUCH MEDIA

(75) Inventor: Giorgio Vavassori Bisutti, Bergamo (IT)

(73) Assignee: Policrom Screens S.p.A., Bergamo (IT)

( * ) Notice: Subject to any disclaimer, the term of this patent is extended or adjusted under 35 U.S.C. 154(b) by 216 days.

(21) Appl. No.: 13/123,648

(22) PCT Filed: Feb. 18, 2010

(86) PCT No.: PCT/IT2010/000059

§ 371 (c)(1),
(2), (4) Date: Jun. 8, 2011

(87) PCT Pub. No.: WO2011/027375

PCT Pub. Date: Mar. 10, 2011

(65) Prior Publication Data

US 2011/0236608 A1 Sep. 29, 2011

(51) Int. Cl.
*B41M 5/50* (2006.01)

(52) U.S. Cl.
USPC ..... 503/227

(58) Field of Classification Search
USPC ..... 428/32.11, 32.51; 503/227
See application file for complete search history.

(56) References Cited

FOREIGN PATENT DOCUMENTS

| | | |
|---|---|---|
| WO | WO 00/06392 | 2/2000 |
| WO | WO 2007/080377 | 1/2007 |

*Primary Examiner* — Bruce H Hess
(74) *Attorney, Agent, or Firm* — Jordan IP Law, LLC; Todd A. Vaughn

(57) ABSTRACT

An Ink transfer medium configured to receive and transfer an image on a bi-dimensional or tri-dimensional article by way of thermal transfer. The ink transfer medium includes a sub-layer made of amorphous polyethylene terephthalate (APET), an image receiving coating, a barrier coating, a binding system, and an ink transfer coating which includes a layer having a combination of pigment systems formed by cellulose fibers, microspheres and silica. The barrier coating includes resins and mineral elements supporting the ink transfer coating applied on the APET film.

18 Claims, No Drawings

MEDIA USED FOR TRANSFERRING AN IMAGE ON A BI-DIMENSIONAL OR TRI-DIMENSIONAL ARTICLE BY A THERMAL TRANSFER PRINTING PROCESS AND PROCESS FOR MAKING SUCH MEDIA

CROSS REFERENCE TO PRIOR APPLICATIONS

The present application is a National Stage Application of PCT International Application No. PCT/IT2010/000059 (filed on Feb. 18, 2010), under 35 U.S.C. 371, which is hereby incorporated by reference in its entirety.

FIELD OF THE INVENTION

This inventions relates to a process for printing an image on a bi-dimensional or tri-dimensional article and particularly media used for transferring the image and processes for making such media.

BACKGROUND

There are different methods for performing a transfer printing on tri-dimensional articles:

In-Mould Decoration (IMD)

Two different methods are used for performing such printing depending on the structure of the surface to be printed, noteably, Film Insert Moulding (FIM) and In-Mould Labelling (IML).

FIM is generally used to print and mould items with a slight hollow such as mobile phone shell, touch screen panels, etc.

IML is mainly used to mould printed labels on plastic containers used for food packaging, such as ice cream boxes, cheese, etc.

The injection and forming devices needed for the FIM and moulding tools and equipment for the IML are very expensive and make these techniques adequate only for high volume production runs. Another drawback with these printing systems is that each item requires a specific mould.

Cubic Printing (Dip Coating)

Cubic printing method is a method that allows a print to be transferred onto a tridimensional plastic material, especially large hollow articles that can be easily crushed, by way of a special film that leaves a floating layer of inks into which the article to be decorated is immerged.

Cubic printing method needs specialized tooling and equipment, such as a water basin where the film is floating and the article is placed on the film. This process is acceptable only for graphic elements that do not need a high accuracy in the positioning of the print, typically a pattern that repeats itself. Given the high set-up costs, this process is only cost-effective for high volume production runs.

Digital 3D Sublimation Using an Ink-Jet Printable Film

A thermally formable film especially designed to transfer any graphic image onto a tri-dimensional article is printed using dye and pigment based sublimation inks with standard inkjet piezo technology. Unlike the sublimation papers, which are stiff and dimensionally stable under heat and pressure, coated thermally formable film is designed to take the shape of the article that it is adhered to and to sublimate the image onto the surface of that article.

Generally, the transfer is made on plastic materials (such as PET, PA, PBT, etc.) with melting temperatures above the maximum transfer temperature of 210° C.

It is also possible to transfer the printing onto any type of surface, i.e., wood, metal, glass etc. provided that they are previously coated with a layer of polyester varnish. During the transfer process the ink that is on the top layer sublimates, passing from solid to gaseous state, and thus penetrates the surface of the article to be imaged, making it scratch resistant.

This process requires two steps: a first step involving the printing of an image onto a transfer medium, and a second step involving the transfer of the printing onto the article.

In the first step, this type of printing can be done using a number of methods, screen printing, flexographic printing, offset printing or inkjet printing, as long as the printing is done using sublimation inks. The different type of printing method is due to the equipment already available at the printing shop and the number of copies to be printed that make the specific method cost effective.

In the second step, the important issues are that the medium is thermo formable and that it produces an image with the highest resolution without producing distortions and areas voids of ink. As it is known, this second step is performed by introducing the material into an oven and applying vacuum between the surface of the material and the article to be printed. In the oven, the material can heated in two different ways: the first manner is what is normally referred to as a "convection oven" where the heat is produce by resistive heating elements and the temperature is kept constant through a regulated air flow for even heating of the material. The second type of heating of an oven is an infrared rays (IR) heating system in which infrared lamps heat the material directly with a very even distribution of the heat.

The base product used for making this transfer medium is known on the market as APET (amorphous polyethylene terephthalate). The APET film to be heated in IR ovens is typically metalized to provide a sufficient barrier between the gaseous ink and the APET film in order to prevent the migration towards APET film of the ink gas developed during the sublimation process with resulting reduction of the quality of the transferred image and waste of ink. In addition, the metallic layer improves the adhesion of the ink retention coating.

The shortcomings of the metalized layer are that the operator cannot see through such layer and it becomes difficult to register accurately the position of the article and the printed image. The advantage of the metalized layer is that it allows a faster and more even heating of the APET in ovens utilizing IR heating system.

In the case in which convection ovens are used, another option is the utilization of a base medium made of APET 160 to 250 microns in thickness with various coatings as described in EP 1392 517 B1.

In both the cases, the transfer film has to be coated/treated for the following reasons. The first reason is so that the transfer film molds itself to conform to the shape of the article to be printed when heated and put under vacuum. The second reason is so that the transfer film retains the sublimation ink and releases it once the sublimation ink has been heated and has reached its gaseous state. The third reason is so that the transfer film releases the ink with the least amount of ink waste. The fourth reason is so that the transfer film releases the ink with the best image definition and color gamut fidelity. The fifth reason is so that the transfer film allows the evacuation of the vapor that is formed during the sublimation process between the film and the surface to be printed without forming any gas bubbles that will result in unprinted areas.

Of all these requirements, the most difficult to meet, are the last two, because they are technically in conflict since, in order to obtain the best possible image definition, it is necessary that the distance between the transfer film and article to be printed is minimal.

With a perfect contact, the ink vapors pass directly from the coating of the transfer film to the surface of the article to be printed maintaining the original definition without any "bleeding." That is typically the process that has been used for sublimation printing of flat surfaces using special papers for sublimation printing already known.

However, in the case of tri-dimensional printing, it is necessary to use a thermo-formable plastic material as the substrate to manufacture the transfer film, and the moist air that is trapped between the two surfaces once it is heated and becomes a vapor, occupies a larger volume and, not being able to escape, it forms bubbles between the thermo-formable plastic material and the surface of the article.

These bubbles, depending on their size, reduce up to neutralizing the ink vapor migration, thus compromising the definition and the fidelity of the image up to a point where there is no transfer of ink at all.

The different patents that have been developed, such as European patent EP 1.102.682.B1 and U.S. Patent Publication No. 2009/0068383 A1, have pointed out the necessity of a coating with a surface roughness defined in BEKK (less than 50") that allows a good image definition and permits the air to escape.

These different coatings described have formulations based principally on the dispersion of a pigment system in one of many resins used as a binder and as a receptor for sublimation ink. It is the choice of the type of pigment system and its granular dimension that determines the roughness of the surface. All of these publications describe the use of silica in different dimensions but calibrated to maintain the surface roughness desired. The problem derived from the use of these silica particles is that they are an inefficient manner for air dissipation. Additionally, since the silica provides the important function to absorb the ink in its liquid phase and than release it during the sublimation cycle, the formulations described only release a partial quantity of that ink during the sublimation cycle.

The effort to limit as much as possible the loss of ink during the transfer phase, requires that the APET thermo formable film is isolated by an appropriate treatment from the flow of ink vapors during the transfer. This barrier treatment is normally obtained through a deposition of thin layer of metal (i.e. aluminum), through a sputtering process or vacuum metallization. This technology allows to obtain good results in terms of barrier and to optimize the performance of ovens using IR technology but it has shortcomings in terms of cost, fragility of the thin metal layer as the base for further coatings and finally, but most importantly, the metal blocks the light. This last factor makes it difficult to track and position the film over the article to be printed.

Many of the resins that are of common knowledge and that are utilized as a primer for further coating have little compatibility with the aqueous based top coating and a high level of absorption for sublimation inks, so that they will not work as a barrier.

SUMMARY

The object of this invention is to furnish an APET film coating suitable for the ink transfer made of a combination of pigment systems, made not only of silica, that optimizes the surface roughness, with a better ink retention and the highest amount of ink restitution during the sublimation process, thus eliminating the costs associate with the loss of ink, but above all in the best condition to permit that the air pressure that is created by the ink vapors during the sublimation process under vacuum is released.

A further object of the invention is to define a barrier coating based on a treatment or chemical coating of the surface of the APET (amorphous polyethylene-terephthalate) film that replaces the metallization described above. This barrier coating made of resins and mineral elements has the function to hold the ink transfer coating described herein (a difficult function for metallic barriers) and in addition this barrier coating needs to be transparent for a number of important applications.

The specific purpose of this invention is to create a barrier coating made of organic resins in an aqueous solution with, if necessary, a mineral or organic pigment system in relationship with the characteristics of the ink transfer coating. A primer that utilizes casein, and/or its derivatives, as its main component, will perform with an excellent bond with the APET film,—whether the APET has been previously received a corona treatment or a chemical surface treatment such as a TCA treatment—a very low coefficient of absorption of ink vapors and finally an optimal compatibility with the ink transfer coating.

DESCRIPTION

It has been discovered, during the development of this invention, that a mixture, made of cellulose fibers of specific dimensions and microspheres of specific dimension and type, allows to reduce totally or partially the utilization of silica and avoid the drawback described above.

This mixture of ink carriers made of cellulose fibers and microspheres is incorporated into a formulation bound by the same type of resins utilized for the production of papers or films for ink jet printing.

It has been found that, in accordance with this invention, the utilization of cellulose fibers having a thickness, for instance, of 15 microns incorporated in a proportion of 5% to 30% of the binding system, and of microspheres of methacrylate in a ratio of 0.20% to 1.00% in relationship with the binder, results in the best compromise: precision in the image detail and color rendition and of the transferred image and good air evacuation, in relationship with the type of oven used and the article to be printed.

The choice to utilize microspheres was driven by the necessity to obtain a high roughness much more homogeneous that the one obtained by using silica alone and at the same time the need to eliminate that the ink is absorbed into the coating at the time of sublimation. Finally the microspheres allow to calibrate exactly the optimal distance between the transfer medium and the article to be printed. The resins normally utilized as binders for these types of formulation are made polyvinyl alcohols, cellulose-based resins with plasticizers or softening agents incorporated into an aqueous or hydro-alcohols.

The following Table 1 is an example of a formulation of an ink transfer coating in accordance with the invention.

TABLE 1

| | | | |
|---|---|---|---|
| Premix 1 | Water at 20° C. | 80 | Kg |
| | Sodium hydroxide | 5 | Kg |
| | Casein | 15 | Kg |
| | Stir until dissolution | | |
| Premix 2 | Water at 2° C. | 60 | Kg |
| | Aerosil 200 | 10 | Kg Silice-Degussa |
| | Gasil | 30 | Kg Silice-Grace |
| | Stir 30 minutes with turbo mix | | |
| Premix 3 | Water at 50° C. | 82 | Kg |
| | Cellosize Wp09 | 9 | Kg Idrossietilcellulosa (Hercules Inc.) |

TABLE 1-continued

| | | | |
|---|---|---|---|
| | Methocel | 3 Kg | Metilcellulosa-Hercules Inc. |
| | CMC | 6 Kg | Carbossimetilcellulosa-Hercules Inc. |
| | Stir until dissolution | | |
| Premix 4 | Water at 20° C. | 75 Kg | |
| | isopropylic | 5 Kg | |
| | alcohol | 3 Kg | Cellulose fibers-J. Rettenmaier & Sohne GMBH |
| | Arbocel 1 | 2 Kg | Cellulose fibers-CWA Angelbachtal |
| | Arbocel 2 | 0.5 Kg | Microsfere-Japan Steel Works |
| | MRG 30 My | 0.6 Kg | Microsfere-Japan Steel Works |
| | MRG 50 MY | 0.2 Kg | Microsfere-Japan Steel Works |
| | MRG 60 MY | | |

The final batch is obtained by mixing and adding under stirring, in this order, 20 Kg of Premix 1, 10 Kg of Premix 2, 18 Kg of Premix 3 and 10 Kg of Premix 4 and finally water in a quantity suitable to reach the desired viscosity form 800 to 1100 centipoises for producing the coating head layer.

In accordance with the invention, a barrier coating is provided based on a treatment or chemical coating of the surface of the APET (amorphous polyethylene-terephthalate) film. Such a barrier coating made of resins and mineral elements has a function to hold the ink transfer coating described hereinabove (a difficult function for metallic barriers). Moreover, the barrier coating needs to be transparent for a number of important applications.

This type of barrier coating, also called primer, is applied to the APET film with a technique that is similar to the one used for the ink transfer coating. This allows the two coatings to be applied in line on the same production plant.

In accordance with the invention, a barrier coating is provided which is made of organic resins in an aqueous solution with, if necessary, a mineral or organic pigment system in relationship with the characteristics of the ink transfer coating. A primer that utilizes casein, and/or its derivatives, as its main component, will perform with an excellent bond with the APET film, whether the APET has been previously received a corona treatment or a chemical surface treatment such as a TCA treatment, a very low coefficient of absorption of ink vapors and finally an optimal compatibility with the ink transfer coating.

The following description is an example of a formulation of a barrier coating to illustrate the invention. Under constant agitation a solution of lactic casein in hot water, with a mix rate between 5% and 20% with an addition of ammonium hydroxide between 2 and 7% is prepared. The application can be done by using classical techniques in order to obtain a dry coating between 1,5 and 5 gr. per square meter.

The following description is an example of a pre-treatment of the APET based on TCA etching. A solution of PVA (polyvinyl alcohol), with a concentration between 1 and 10% in water, and TCA (trichloroacetic acid), with a concentration between 3 and 20%, is prepared under stirring. This solution is applied on a APET film by way of an air knife or Meyer bar system in order to obtain a wet coat weight in a range between 3 and 10 gr/square meter depending on the specific characteristics of the film and the final coating. This coating needs to be dried in adequate conditions.

In addition this invention allows a better use of a conventional barrier coating made of a metalized layer which, even if it suffers of the hereinbefore cited drawbacks of difficulty in consenting a correct alignment, it would be, however, more efficient in the case of use of infrared ovens combined with an ink transfer coating including a combination in accordance with the invention of pigment systems formed by cellulose fibers and microspheres which eliminate the production of bubbles.

It is to be understood that, having described an illustrative but not limiting embodiment of the invention, this latter is susceptible of a lot of changes and variations all falling within the inventive principle disclosed in the accompanying claims, while the technical details may be varied in accordance with particular requirements and the technical developments.

The invention claimed is:

1. An ink transfer medium configured to receive and transfer an image on a bi-dimensional or tri-dimensional article by way of thermal transfer, said ink transfer medium comprising:

a sub-layer comprising amorphous polyethylene terephthalate (APET);

a binder;

a barrier coating applied to the binder and which comprises resins and mineral elements;

an image receiving coaling applied to the barrier coating;

an ink transfer coating applied to the image receiving coating and comprising a combination of pigment systems formed by cellulose fibers and microspheres, wherein the binder is configured to bond the barrier coating, the image receiving coating and the ink transfer coating to the APET sub-layer.

2. The ink transfer medium of claim 1, wherein the resins comprise organic resins.

3. The ink transfer medium of claim 2, wherein the organic resins of the barrier coating are applied in an aqueous solution with a mineral or organic pigment system.

4. The ink transfer medium of claim 2, wherein the organic resins are formed by casein and its derivates.

5. The ink transfer medium of claim 2, wherein the organic resins of the barrier coating are applied in solutions of 5-20% of lactic casein in water and 2-7% of ammonium hydroxide to form.

6. The ink transfer medium of claim 2, wherein the barrier coating comprises an anhydrous coating of 1.5-5 gr/m$^2$.

7. The ink transfer medium of claim 1, wherein the ink transfer coating comprise:

cellulose fibers having a predetermined thickness and which are incorporated in a proportion of 5% to 30% of the binder; and microspheres of methacrylate in a ratio of 0.20% to 1.00% in relationship to the binder.

8. The ink transfer medium of claim 7, wherein the predetermined thickness is 15 micron.

9. The ink transfer medium of claim 1, wherein the ink transfer coating further comprises silica.

10. The ink transfer medium of claim 1, wherein the binder comprises resins chosen among polyvinyl alcohols, cellulose-based resins with plasticizers and softening agents incorporated into an aqueous alcohol or a hydro-alcohol.

11. The ink transfer medium of claim 1, wherein the barrier coating is comprises a metalized layer.

12. A process for obtaining an ink transfer medium configured to receive and transfer an image on a bi-dimensional or tri-dimensional article by way of thermal transfer, the process comprising:

preparing a first solution comprising polyvinyl alcohol (PVA) with a concentration between 1 and 10% in water, and trichloroacetic acid (TCA) with a concentration between 3 and 20%;

providing a barrier coating by preparing under constant stirring a second solution comprising lactic casein in hot water, with a mix rate between 5% and 20%, and ammonium hydroxide between 2% and 7% to obtain a dry coating between 1.5 and 5 gr/m$^2$;

providing an ink transfer coating by preparing cellulose fibers in a proportion of 5% to 30% of a binder and having a predetermined thickness, and microspheres of methacrylate in a ratio of 0.20% to 1.00% in relationship to the binder;

pre-treating an amorphous polyethylene terephthalate (APET) sub-layer by applying the first solution on the sub-layer to obtain a wet coat weight in a range between 3 and 10 gr/m$^2$, and then drying the wet coating; and applying on the sub-layer an image receiving coating, the ink transfer coaling and the barrier coating.

13. The process of claim 12, wherein the solution is applied using a precision application system.

14. The process of claim 13, wherein the precision application system comprises an air knife.

15. The process of claim 13, wherein the precision application system comprises a Meyer bar system.

16. The process of claim 13, wherein the predetermined thickness of the cellulose fibers is 15 microns.

17. An ink transfer medium comprising:

an amorphous polyethylene terephthalate (APET) sub-layer:

a binder comprising resins chosen among polyvinyl alcohols, cellulose-based resins with plasticizers and softening agents incorporated into an aqueous alcohol or a hydro-alcohol;

an image receiving coating applied to the binder; and an ink transfer coating applied to the image receiving coating and comprising a combination of pigment systems formed by cellulose fibers and microspheres, wherein the binder is configured to bond the image receiving coating and the ink transfer coating to the APET sub-layer.

18. The ink transfer medium of claim 17, wherein the ink transfer coating further comprises silica.

* * * * *